US009779691B2

(12) United States Patent
Peana

(10) Patent No.: US 9,779,691 B2
(45) Date of Patent: Oct. 3, 2017

(54) DISPLAY FRONT OF SCREEN PERFORMANCE ARCHITECTURE

(71) Applicant: Dell Products, LP, Round Rock, TX (US)

(72) Inventor: Stefan Peana, Austin, TX (US)

(73) Assignee: DELL PRODUCTS, LP, Round Rock, TX (US)

( * ) Notice: Subject to any disclaimer, the term of this patent is extended or adjusted under 35 U.S.C. 154(b) by 129 days.

(21) Appl. No.: 14/604,384

(22) Filed: Jan. 23, 2015

(65) Prior Publication Data

US 2016/0217765 A1 Jul. 28, 2016

(51) Int. Cl.
*G09G 5/06* (2006.01)
*G09G 5/00* (2006.01)

(52) U.S. Cl.
CPC ..... *G09G 5/06* (2013.01); *G09G 5/005* (2013.01); *G09G 2300/0452* (2013.01); *G09G 2320/0666* (2013.01); *G09G 2320/0693* (2013.01); *G09G 2340/0457* (2013.01); *G09G 2340/06* (2013.01); *G09G 2360/144* (2013.01); *G09G 2370/042* (2013.01); *G09G 2370/047* (2013.01)

(58) Field of Classification Search
None
See application file for complete search history.

(56) References Cited

U.S. PATENT DOCUMENTS 8,520,023 B2 8/2013 Sullivan et al.
8,860,781 B2 10/2014 Nagaraj et al.
2004/0174389 A1* 9/2004 Ben-David ..... G09G 3/3413 345/694
2006/0082560 A1 4/2006 Greer et al.
2008/0259011 A1* 10/2008 Hayashi ..... G09G 3/2003 345/87
2008/0303918 A1* 12/2008 Keithley ..... G09G 3/20 348/223.1
2009/0027401 A1* 1/2009 Loveridge ..... G09G 5/006 345/501
2012/0013635 A1* 1/2012 Beeman ..... G09G 3/2003 345/590
2013/0038790 A1* 2/2013 Seetzen ..... G09G 5/02 348/453
2013/0093783 A1* 4/2013 Sullivan ..... G09G 5/06 345/601
2013/0222408 A1* 8/2013 Lee ..... G09G 3/3466 345/589

(Continued)

OTHER PUBLICATIONS

Klompenhouwer et al, "Subpixel Image Scaling for Color Matrix Displays", Journal of the SID, 11(1), 2003.*

(Continued)

*Primary Examiner* — Ulka Chauhan
*Assistant Examiner* — Patrick F Valdez
(74) *Attorney, Agent, or Firm* — Larson Newman, LLP

(57) ABSTRACT

An information handling system can include a display for displaying an image and a graphics processing unit. The graphics processing unit can select a display color table based on a display type determined based on extended data identification data for the display, receive an input image into a graphics processing unit, perform image contrast and sharpness calculations on the input image, perform a color optimization using the display color table, and provide an output image to the display.

20 Claims, 5 Drawing Sheets

(56) References Cited

U.S. PATENT DOCUMENTS

| | | | | |
|---|---|---|---|---|
| 2014/0078165 | A1* | 3/2014 | Messmer | H04N 1/603 345/589 |
| 2014/0125687 | A1* | 5/2014 | Saulters | G06T 15/04 345/582 |
| 2014/0210848 | A1* | 7/2014 | Iwafuchi | G09G 5/02 345/593 |
| 2015/0062148 | A1* | 3/2015 | Morovic | G09G 5/06 345/593 |
| 2015/0363944 | A1* | 12/2015 | Elliott | H04N 9/045 345/589 |

OTHER PUBLICATIONS

Elliott C.H.B., "Image Reconstruction on Color Sub-pixelated Displays", in "Mobile Displays: Technology and Applications", eds. Bhowmik A.K., Li Z.,Bos P.J., John Wiley & Sons, Ltd, Chichester, UK, 2008.*

"Front-of-screen (FOS) display components are key to optimizing optical performance in displays as well as user experiences," Iona Bita et al., SID; Society for Information Display, © 2011-2013.

* cited by examiner

DISPLAY FRONT OF SCREEN PERFORMANCE ARCHITECTURE

FIELD OF THE DISCLOSURE

The present disclosure generally relates to information handling systems, and more particularly relates to display front of screen performance architecture.

BACKGROUND

As the value and use of information continues to increase, individuals and businesses seek additional ways to process and store information. One option is an information handling system. An information handling system generally processes, compiles, stores, or communicates information or data for business, personal, or other purposes. Technology and information handling needs and requirements can vary between different applications. Thus information handling systems can also vary regarding what information is handled, how the information is handled, how much information is processed, stored, or communicated, and how quickly and efficiently the information can be processed, stored, or communicated. The variations in information handling systems allow information handling systems to be general or configured for a specific user or specific use such as financial transaction processing, airline reservations, enterprise data storage, or global communications. In addition, information handling systems can include a variety of hardware and software resources that can be configured to process, store, and communicate information and can include one or more computer systems, graphics interface systems, data storage systems, networking systems, and mobile communication systems. Information handling systems can also implement various virtualized architectures. Data and voice communications among information handling systems may be via networks that are wired, wireless, or some combination.

BRIEF DESCRIPTION OF THE DRAWINGS

It will be appreciated that for simplicity and clarity of illustration, elements illustrated in the Figures are not necessarily drawn to scale. For example, the dimensions of some elements may be exaggerated relative to other elements. Embodiments incorporating teachings of the present disclosure are shown and described with respect to the drawings herein, in which.

The use of the same reference symbols in different drawings indicates similar or identical items.

DETAILED DESCRIPTION OF THE DRAWINGS

The following description in combination with the Figures is provided to assist in understanding the teachings disclosed herein. The description is focused on specific implementations and embodiments of the teachings, and is provided to assist in describing the teachings. This focus should not be interpreted as a limitation on the scope or applicability of the teachings.

Figure 1:
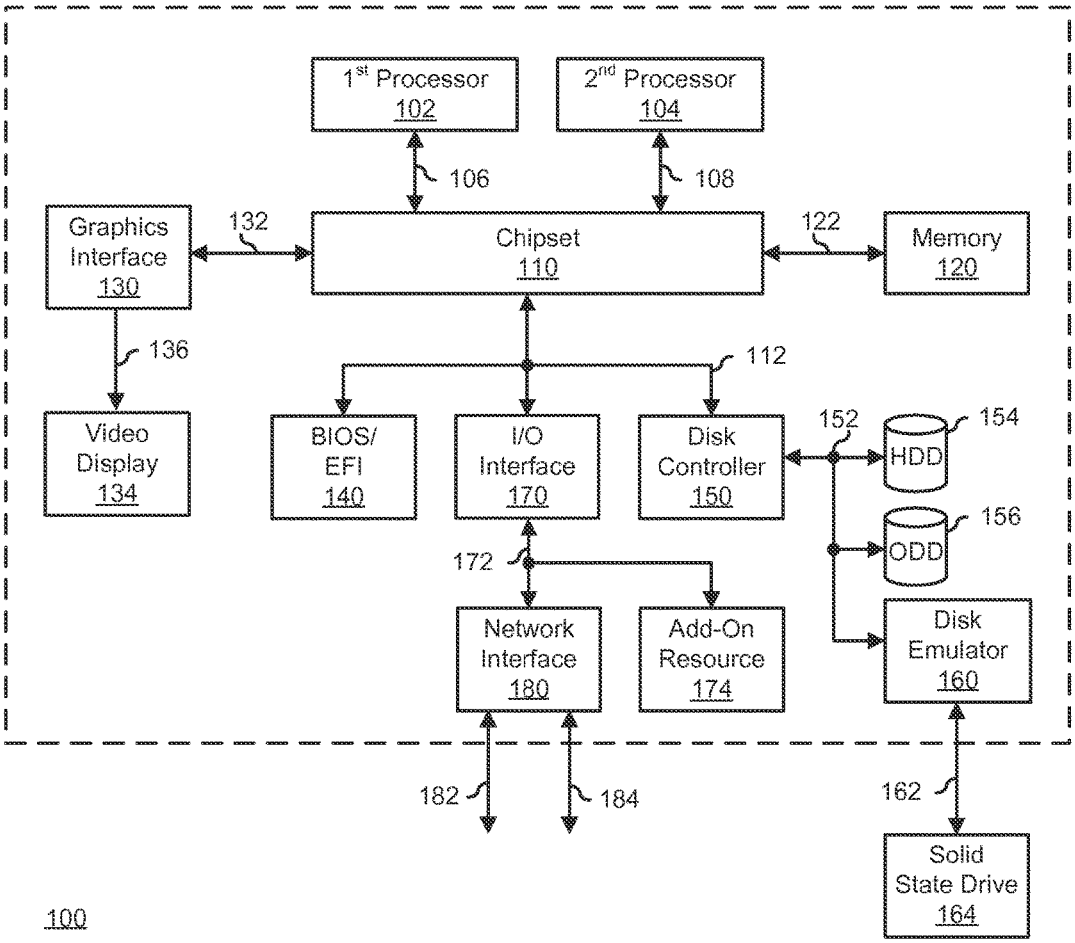
FIG. 1 is a block diagram illustrating an information handling system according to an embodiment of the present disclosure.

FIG. 1 illustrates a generalized embodiment of information handling system 100. For purpose of this disclosure information handling system 100 can include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, entertainment, or other purposes. For example, information handling system 100 can be a personal computer, a laptop computer, a smart phone, a tablet device or other consumer electronic device, a network server, a network storage device, a switch router or other network communication device, or any other suitable device and may vary in size, shape, performance, functionality, and price. Further, information handling system 100 can include processing resources for executing machine-executable code, such as a central processing unit (CPU), a programmable logic array (PLA), embedded device such as a System-on-a-Chip (SoC), or other control logic hardware. Information handling system 100 can also include one or more computer-readable medium for storing machine-executable code, such as software or data. Additional components of information handling system 100 can include one or more storage devices that can store machine-executable code, one or more communications ports for communicating with external devices, and various input and output (I/O) devices, such as a keyboard, a mouse, and a video display. Information handling system 100 can also include one or more buses operable to transmit information between the various hardware components.

Information handling system 100 can include devices or modules that embody one or more of the devices or modules described above, and operates to perform one or more of the methods described above. Information handling system 100 includes a processors 102 and 104, a chipset 110, a memory 120, a graphics interface 130, include a basic input and output system/extensible firmware interface (BIOS/EFI) module 140, a disk controller 150, a disk emulator 160, an input/output (I/O) interface 170, and a network interface 180. Processor 102 is connected to chipset 110 via processor interface 106, and processor 104 is connected to chipset 110 via processor interface 108. Memory 120 is connected to chipset 110 via a memory bus 122. Graphics interface 130 is connected to chipset 110 via a graphics interface 132, and provides a video display output 136 to a video display 134. In a particular embodiment, information handling system 100 includes separate memories that are dedicated to each of processors 102 and 104 via separate memory interfaces. An example of memory 120 includes random access memory (RAM) such as static RAM (SRAM), dynamic RAM (DRAM), non-volatile RAM (NV-RAM), or the like, read only memory (ROM), another type of memory, or a combination thereof.

BIOS/EFI module 140, disk controller 150, and I/O interface 170 are connected to chipset 110 via an I/O channel 112. An example of I/O channel 112 includes a Peripheral Component Interconnect (PCI) interface, a PCI-Extended (PCI-X) interface, a high-speed PCI-Express (PCIe) interface, another industry standard or proprietary communication interface, or a combination thereof. Chipset 110 can also include one or more other I/O interfaces, including an Industry Standard Architecture (ISA) interface, a Small Computer Serial Interface (SCSI) interface, an Inter-Integrated Circuit ($I^2C$) interface, a System Packet Interface (SPI), a Universal Serial Bus (USB), another interface, or a combination thereof. BIOS/EFI module 140 includes BIOS/EFI code operable to detect resources within information handling system 100, to provide drivers for the resources, initialize the resources, and access the resources. BIOS/EFI module 140 includes code that operates to detect resources within information handling system 100, to provide drivers for the resources, to initialize the resources, and to access the resources.

Disk controller 150 includes a disk interface 152 that connects the disc controller to a hard disk drive (HDD) 154, to an optical disk drive (ODD) 156, and to disk emulator 160. An example of disk interface 152 includes an Integrated Drive Electronics (IDE) interface, an Advanced Technology Attachment (ATA) such as a parallel ATA (PATA) interface or a serial ATA (SATA) interface, a SCSI interface, a USB interface, a proprietary interface, or a combination thereof. Disk emulator 160 permits a solid-state drive 164 to be connected to information handling system 100 via an external interface 162. An example of external interface 162 includes a USB interface, an IEEE 1194 (Firewire) interface, a proprietary interface, or a combination thereof. Alternatively, solid-state drive 164 can be disposed within information handling system 100.

I/O interface 170 includes a peripheral interface 172 that connects the I/O interface to an add-on resource 174 and to network interface 180. Peripheral interface 172 can be the same type of interface as I/O channel 112, or can be a different type of interface. As such, I/O interface 170 extends the capacity of I/O channel 112 when peripheral interface 172 and the I/O channel are of the same type, and the I/O interface translates information from a format suitable to the I/O channel to a format suitable to the peripheral channel 172 when they are of a different type. Add-on resource 174 can include a data storage system, an additional graphics interface, a network interface card (NIC), a sound/video processing card, another add-on resource, or a combination thereof. Add-on resource 174 can be on a main circuit board, on separate circuit board or add-in card disposed within information handling system 100, a device that is external to the information handling system, or a combination thereof.

Network interface 180 represents a NIC disposed within information handling system 100, on a main circuit board of the information handling system, integrated onto another component such as chipset 110, in another suitable location, or a combination thereof. Network interface device 180 includes network channels 182 and 184 that provide interfaces to devices that are external to information handling system 100. In a particular embodiment, network channels 182 and 184 are of a different type than peripheral channel 172 and network interface 180 translates information from a format suitable to the peripheral channel to a format suitable to external devices. An example of network channels 182 and 184 includes InfiniBand channels, Fibre Channel channels, Gigabit Ethernet channels, proprietary channel architectures, or a combination thereof. Network channels 182 and 184 can be connected to external network resources (not illustrated). The network resource can include another information handling system, a data storage system, another network, a grid management system, another suitable resource, or a combination thereof.

Figure 2:
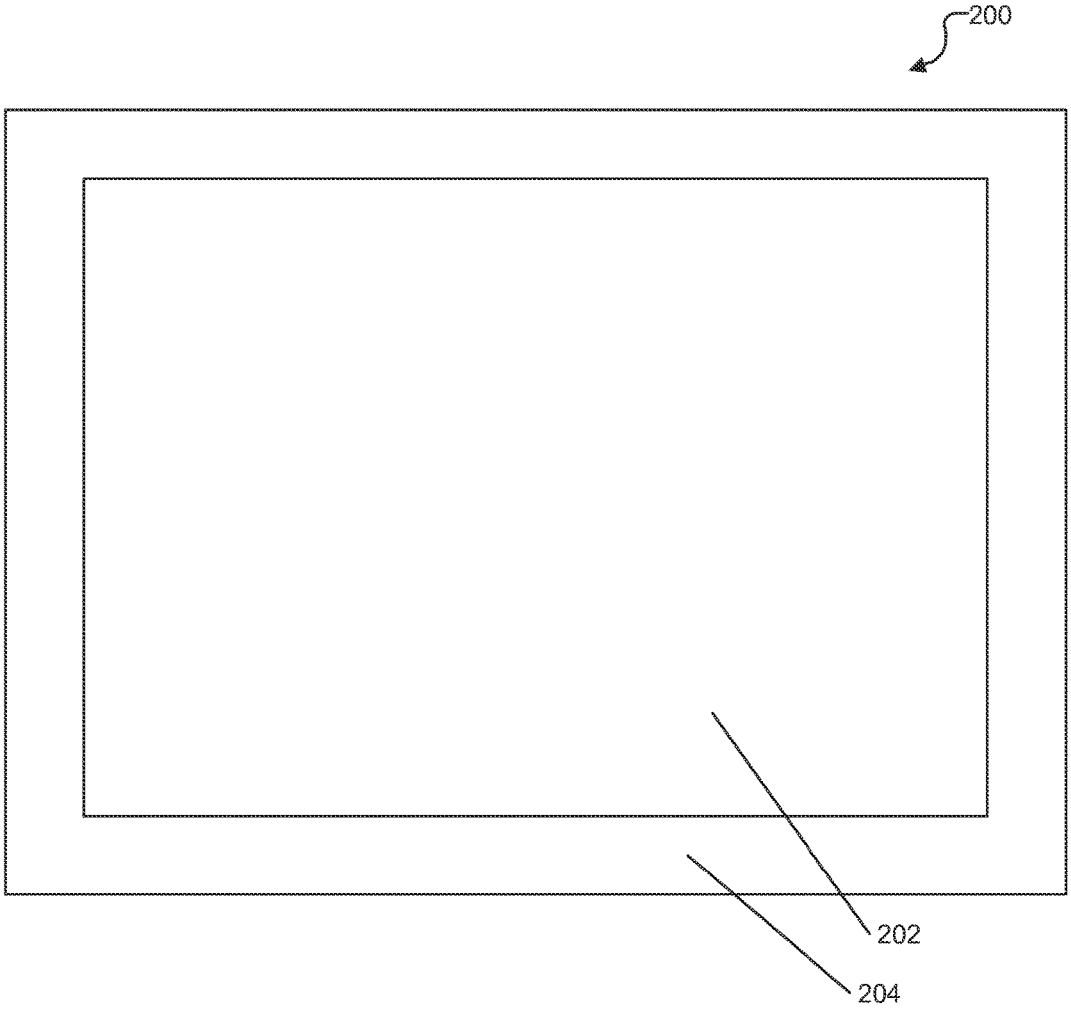
FIG. 2 is a diagram illustrating a surface view of a display.

FIG. 2 illustrates a surface view of a display assembly 200. Active display area 202 can define a center portion of the display assembly surface view 200 and a bezel region 204 can define the perimeter of the display assembly surface view 200. In various embodiments, active display area 202 can also incorporate a touch sensitive area.

Figure 3:
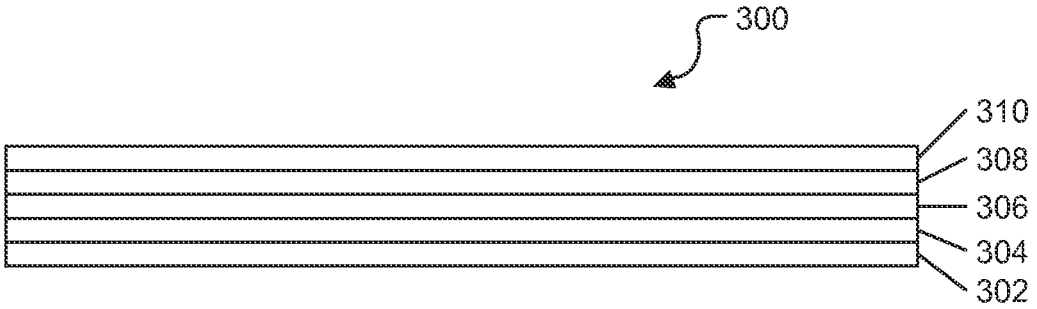
FIG. 3 is a cross-sectional view of a display.

FIG. 3 shows a cross section of a display assembly 300. The display assembly 300 can include a display layer 302, an optically clear adhesive layer 304, an optional touch sensitive layer 306, a cover layer 308, and an antireflective coating 310. In various embodiments, a front-of-screen stack can include the various layers positioned between the display layer 302 and the user and may include additional layers to enhance mechanical robustness, such as cover layer 308, optical performance, such as antireflective coating 310, environmental robustness, such as oleophobic coatings to reduce smudges and fingerprints, and to add functionality, such as touch sensing with the touch sensitive layer 306. Display layer can include a liquid crystal display, an organic light emitting diode display, or other display technology. The optional touch sensitive layer 306 can include resistive touch sensors, capacitive touch sensors, or other touch sensor technologies. Optically clear adhesive layer 304 can bond the display layer and the touch sensitive layer, filling in any air gaps between the layers to improve the optical characteristics of the display assembly. Cover layer 308 can be a glass or plastic layer to protect the display layer 302 and the touch sensitive layer 306. Preferably, cover layer 308 can be a hard layer that is resistant to scratches and breakage. For example, the cover layer 308 can be Corning Gorilla glass. Cover layer 308 can be coated with a antireflective coating or film to reduce glare and reflections from the surface of the display assembly. Optionally, another optically clear adhesive layer (not shown) can be between touch sensitive layer 306 and cover layer 308.

Figure 4A:
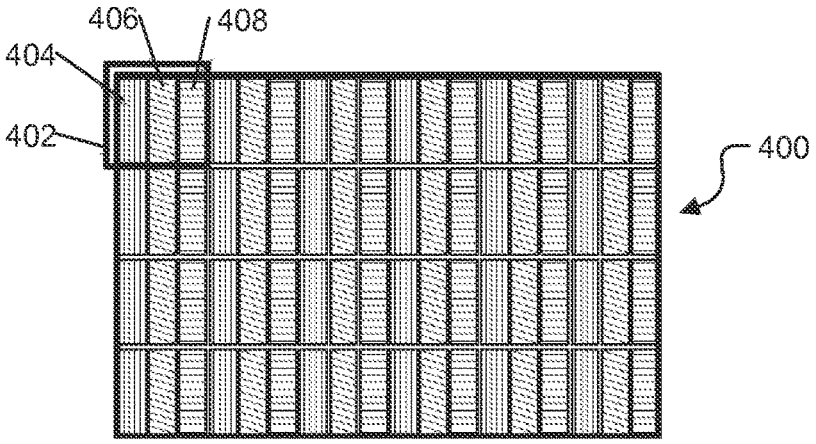
FIGS. 4A, 4B, and 4C are diagrams illustrating various sub-pixel configurations.
Figure 4B:
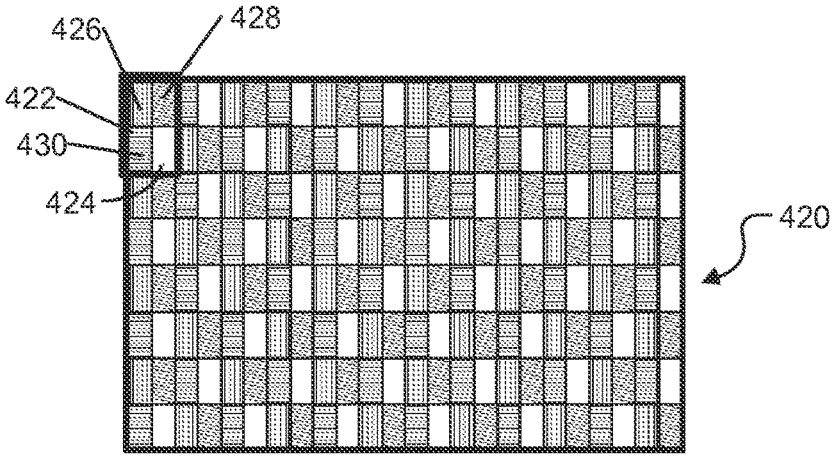
Figure 4C:
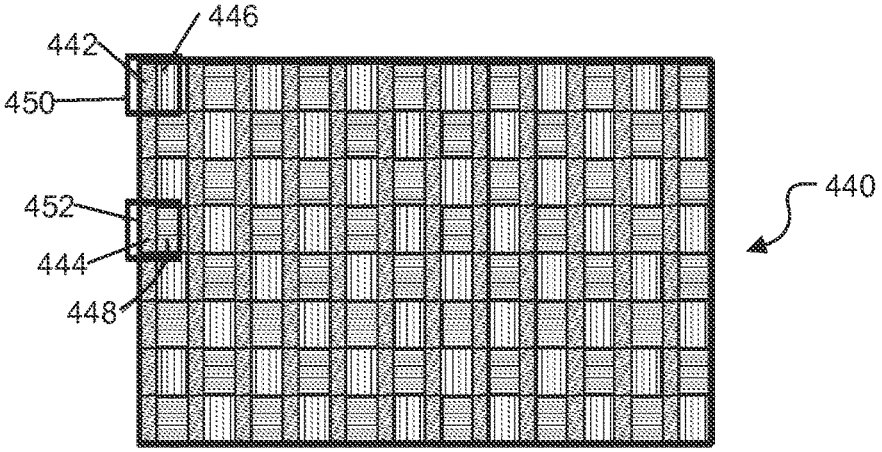

FIGS. 4A-4C show various sub pixel configurations. Historically, displays have used combinations of red, green, and blue subpixels to generate the spectrum of colors seen by the human eye. FIG. 4A illustrates an embodiment of a standard RGB configuration with each pixel comprising a red sub-pixel, a green sub-pixel, and a blue sub-pixel. More recently, other sub-pixel configurations have been developed incorporating additional sub-pixels to improve the color quality, brightness, and dynamic range of the display.

FIG. 4B shows an exemplary RGBW configuration, which include a white (or sometimes yellow) sub-pixel in addition to the red, green, and blue sub-pixels. The white sub-pixel can be used to increase the overall transmittance of the pixel, while the red, green, and blue sub-pixels can be used to control the color of the pixel. Overall, the use of the white sub-pixel can increase the brightness of the display.

FIG. 4C shows an exemplary RGBG configuration that can be used in Active Matrix Organic Light Emitting Diode (AMOLED) and plasma displays. The RGBG configuration uses green sub-pixels interleaved with alternating red and blue sub-pixels. In various embodiments, the human eye can be most sensitive to green, especially for high resolution luminance information. The green sub-pixels can be mapped to input pixels on a one to one basis with the red and blue sub-pixels being subsampled to reconstruct the aroma signal at a lower resolution. The green sub-pixels can provide for a majority of the reconstruction of the luminance signal. While the red and blue sub-pixels can reconstruct the horizontal and vertical spatial frequencies, they may not reconstruct the highest diagonal spatial frequencies. Diagonal high spatial frequency information in the red and blue channels of the input image can be transferred to the green sub-pixels for image reconstruction. RGBG configuration can create a color display with one third fewer sub-pixels than a traditional RGB configuration but with the same measured luminance display resolution.

Figure 5:
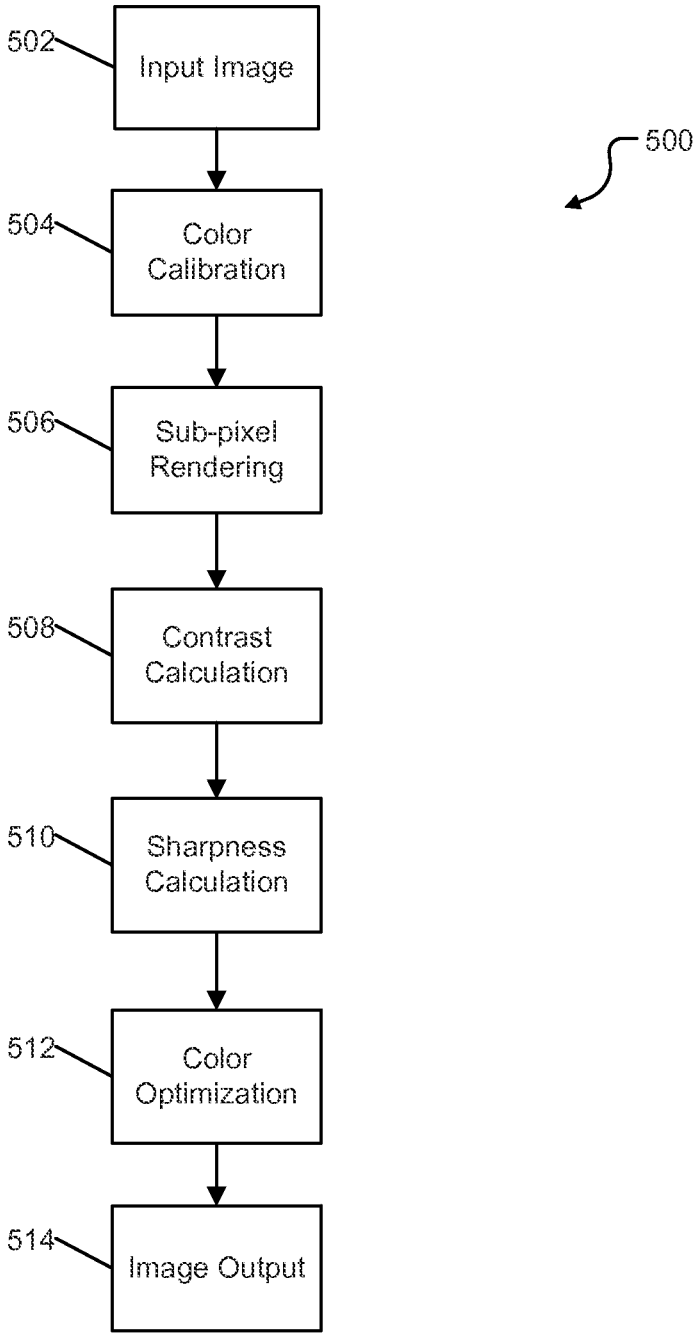
FIG. 5 is a flow diagram illustrating a method of processing an image for display.

FIG. 5 shows an exemplary method 500 of processing an image for display. Method 500 can enhance the user front-of-screen experience, such as by efficiently enhancing sharpness, contrast, color, and the like. In various embodiments, the enhancements can be display type specific to account for various display differences, such as in sub-pixel arrangements and front-of-screen stacks. Input image 502 can be provided to a graphics architecture, such as graphics interface 130, for display on a video display, such as video display 134. In various embodiments, the information handling system can obtain information about the display, such as sub-pixel configuration, display resolution, brightness, primary colors, white point, and the like from the extended display identification data (EDID). In various embodiments, the information can be obtained directly from the EDID or a display type can be obtained from the EDID and some or all of the information about the display can be obtained by looking up the display type. Additionally, the information handling system can obtain 2-dimensional and 3-dimensional look-up tables (LUTs). The LUTs can be specific for the display.

At 504, the image can be color calibrating to match the color space of the image to the color space of the display. Color calibration can be performed based on a set of color tables specific for the display, based on the information obtained from the EDID. Additionally, information from the user interface, such as settings for color boost, skin tones, white point, and the like, or information from sensors, such as the brightness and color of the ambient light, can be used during color calibration of the input image. In various embodiments, the color information for each pixel of the input image can be read and can be converted to an output color for each pixel based on a color table, such as a color table stored in a GPU shader memory.

At 506, the image can be mapped to the pixels and sub-pixels of the display. In various embodiments, the resolution of the input image may not match the resolution of the display, and the pixels of the image may mapped to the pixels of the display in a non 1:1 mapping, such as by scaling the image. In various embodiments, the pixel mapping can depend on a configuration of the sub-pixels of the display. The configuring can be determined based on information obtained by the EDID. In various embodiments, the mapping of the pixels may be calculated based on the display configuration, such as in a graphics processing unit (GPU) rather than relying on a set of pixel mappings stored in a timing controller (TCON) of the display. In this way, the system can be dynamic and respond to any display configurations rather than needing to rely upon a fixed set of pre-generated pixel mapping provided by the display.

At 508, a contrast calculation can be performed, and at 510, a sharpness calculation can be performed. In various embodiments, the contrast and the sharpness calculations can be performed to enhance the contrast and sharpness of the image on the video display. Various techniques are known in the art to perform the contrast and sharpness calculations, and can be used in accordance with various embodiments.

At 512, a color optimization can be performed. Various techniques are known in the art to perform the color optimization, such as described in U.S. Pat. No. 8,520,023, incorporated herein in its entirety. In various embodiments, the color optimization can be performed using display color tables, such as two-dimensional and three-dimensional look up tables. The display color tables can be selected based on the display type, as determined from the EDID. Further, the display color tables can be updated based on user settings or light sensor readings. In various embodiments, the display color tables can be generated based on averaging color tables above and below the user settings or light sensor readings.

At 514, an output image can be displayed on a video display, such as video display 134. In various embodiments, the calibration, sub-pixel rendering, and the contrast and sharpness calculations and color optimization can be performed by a graphics processing unit. The calibration, sub-pixel rendering, and contrast and sharpness calculations can be performed in various alternative orders, such as necessary to improve performance of the graphics system. By performing these processes in the graphic processing unit rather than performing some or all of these calculations and optimizations in the TCON of the display, the system can be more adaptable to display types and can be more adaptable to incorporating additional algorithms to further enhance display performance.

While the computer-readable medium is shown to be a single medium, the term "computer-readable medium" includes a single medium or multiple media, such as a centralized or distributed database, and/or associated caches and servers that store one or more sets of instructions. The term "computer-readable medium" shall also include any medium that is capable of storing, encoding, or carrying a set of instructions for execution by a processor or that cause a computer system to perform any one or more of the methods or operations disclosed herein.

In a particular non-limiting, exemplary embodiment, the computer-readable medium can include a solid-state memory such as a memory card or other package that houses one or more non-volatile read-only memories. Further, the computer-readable medium can be a random access memory or other volatile re-writable memory. Additionally, the computer-readable medium can include a magneto-optical or optical medium, such as a disk or tapes or other storage device to store information received via carrier wave signals such as a signal communicated over a transmission medium. Furthermore, a computer readable medium can store information received from distributed network resources such as from a cloud-based environment. A digital file attachment to an e-mail or other self-contained information archive or set of archives may be considered a distribution medium that is equivalent to a tangible storage medium. Accordingly, the disclosure is considered to include any one or more of a computer-readable medium or a distribution medium and other equivalents and successor media, in which data or instructions may be stored.

In the embodiments described herein, an information handling system includes any instrumentality or aggregate of instrumentalities operable to compute, classify, process, transmit, receive, retrieve, originate, switch, store, display, manifest, detect, record, reproduce, handle, or use any form of information, intelligence, or data for business, scientific, control, entertainment, or other purposes. For example, an information handling system can be a personal computer, a consumer electronic device, a network server or storage device, a switch router, wireless router, or other network communication device, a network connected device (cellular telephone, tablet device, etc.), or any other suitable device, and can vary in size, shape, performance, price, and functionality.

The information handling system can include memory (volatile (such as random-access memory, etc.), nonvolatile (read-only memory, flash memory etc.) or any combination thereof), one or more processing resources, such as a central processing unit (CPU), a graphics processing unit (GPU), hardware or software control logic, or any combination thereof. Additional components of the information handling system can include one or more storage devices, one or more communications ports for communicating with external devices, as well as, various input and output (I/O) devices, such as a keyboard, a mouse, a video/graphic display, or any combination thereof. The information handling system can also include one or more buses operable to transmit communications between the various hardware components. Portions of an information handling system may themselves be considered information handling systems.

When referred to as a "device," a "module," or the like, the embodiments described herein can be configured as hardware. For example, a portion of an information handling system device may be hardware such as, for example, an integrated circuit (such as an Application Specific Integrated Circuit (ASIC), a Field Programmable Gate Array (FPGA), a structured ASIC, or a device embedded on a larger chip), a card (such as a Peripheral Component Interface (PCI) card, a PCI-express card, a Personal Computer Memory Card international Association (PCMCIA) card, or other such expansion card), or a system (such as a motherboard, a system-on-a-chip (SoC), or a stand-alone device).

The device or module can include software, including firmware embedded at a device, such as a Pentium class or PowerPC™ brand processor, or other such device, or software capable of operating a relevant environment of the information handling system. The device or module can also include a combination of the foregoing examples of hardware or software. Note that an information handling system can include an integrated circuit or a board-level product having portions thereof that can also be any combination of hardware and software.

Devices, modules, resources, or programs that are in communication with one another need not be in continuous communication with each other, unless expressly specified otherwise. In addition, devices, modules, resources, or programs that are in communication with one another can communicate directly or indirectly through one or more intermediaries.

Although only a few exemplary embodiments have been described in detail herein, those skilled in the art will readily appreciate that many modifications are possible in the exemplary embodiments without materially departing from the novel teachings and advantages of the embodiments of the present disclosure. Accordingly, all such modifications are intended to be included within the scope of the embodiments of the present disclosure as defined in the following claims. In the claims, means-plus-function clauses are intended to cover the structures described herein as performing the recited function and not only structural equivalents, but also equivalent structures.

What is claimed is:

1. An information handling system comprising:
a display for displaying an image;
a graphics processing unit to:
select multiple display color tables based on the display type determined based on extended display identification data for the display;
generate a target display color table by averaging the multiple display color tables based on a user input setting or light sensor reading;
receive an input image into a graphics processing unit;
perform pixel color calibration on the input image using profile data read from the extended display identification data;
determine a sub-pixel configuration based on the extended display identification data:
map the input image to sub-pixels of the display using the sub-pixel configuration including transferring diagonal high spatial frequency information from red and blue channels of the image to the green sub-pixels;
perform image contrast and sharpness calculations on the input image;
perform a color optimization using the display color table; and
provide an output image to the display.

2. The information handling system of claim 1, further comprising obtaining the user input setting for the color optimization and averaging display color tables above and below the user input setting to generate the target display color table.

3. The information handling system of claim 1, further comprising obtaining the light sensor reading and averaging display color tables above and below the light sensor reading to generate the target display color table.

4. The information handling system of claim 3, wherein the light sensor reading is an ambient light brightness, an ambient light color, or any combination thereof.

5. The information handling system of claim 1, wherein the color optimization depends on a pixel configuration determined based on the extended display identification data.

6. The information handling system of claim 5, wherein the pixel configuration is a four-color pixel configuration.

7. An information handling system comprising:
a display for displaying an image; and
a graphics processing unit to:
select multiple display color tables based on a display type determined based on extended display identification data for the display;
generate a target display color table by averaging the multiple display color tables based on a user input setting or light sensor reading;
receive an input image into a graphics processing unit;
determine a sub-pixel configuration based on the extended display identification data;
perform pixel remapping calculation to map pixels of the input image to sub-pixels of the display using the pixel configuration such that a first portion of the sub-pixels provide high resolution luminance information and a second portion of the sub-pixels reconstruct a chroma signal at a lower resolution and diagonal high spatial frequency information is transferred from red and blue channels of the image to the green sub-pixels;
perform image contrast and sharpness calculations on the input image;
perform a color optimization using the target display color table; and
providing an output image to the display.

8. The information handling system of claim 7, further comprising obtaining the user input setting for the color optimization and averaging display color tables above and below the user input setting to generate the target display color table.

9. The information handling system of claim 7, further comprising obtaining the light sensor reading and averaging display color tables above and below the light sensor reading to generate the target display color table.

10. The information handling system of claim 9, wherein the light sensor reading is an ambient light brightness, an ambient light color, or any combination thereof.

11. The information handling system of claim 7, wherein the color optimization depends on a pixel configuration determined based on the extended display identification data.

12. The information handling system of claim 11, wherein the pixel configuration is a four-color pixel configuration.

13. The information handling system of claim 7, wherein the graphics processing unit is further configured to calculate a pixel map based on the display configuration, and wherein the graphics processor is configured to use the calculated pixel map when performing the pixel remapping calculation.

14. A method of generating an image on a display, the method comprising:

determining a display type based on extended display identification data for the display;

selecting multiple display color tables based on the display type;

generate a target display color table by averaging the multiple display color tables based on a user input setting or light sensor reading;

receiving an input image into a graphics processing unit;

determining a sub-pixel configuration based on the extended display identification data;

using a graphics processing unit to perform a pixel remapping calculation to map pixels of the input image to sub-pixels of the display, including mapping high resolution luminance information, diagonal high spatial frequency information, low resolution chroma information, and horizontal and vertical spatial frequency information to various sets of sub-pixels based on the sub-pixel configuration;

using a graphics processing unit to perform pixel color calibration on the input image using profile data read from the extended display identification data;

using the graphics processing unit to perform image contrast and sharpness calculations on the input image;

using the graphics processing unit to perform a color optimization using the target display color table; and displaying a resulting output image on the display.

15. The method of claim 14, further comprising obtaining the user input setting for the color optimization and averaging display color tables above and below the user input setting to generate the target display color table.

16. The method of claim 14, further comprising obtaining the light sensor reading and averaging display color tables above and below the light sensor reading to generate the target display color table.

17. The method of claim 16, wherein the light sensor reading is an ambient light brightness, an ambient light color, or any combination thereof.

18. The method of claim 14, wherein the color optimization depends on a pixel configuration determined based on the extended display identification data.

19. The method of claim 18, wherein the pixel configuration is a four-color pixel configuration.

20. The method of claim 14, further comprising calculating a pixel map based on the display configuration; and wherein using a graphics processing unit to perform a pixel remapping calculation includes using the calculated pixel map.

* * * * *